US008523751B2

(12) United States Patent
Dietschreit

(10) Patent No.: US 8,523,751 B2
(45) Date of Patent: Sep. 3, 2013

(54) ENDLESS SCREW OF A CENTRIFUGE WITH CERAMIC WEAR PLATES

(75) Inventor: Horst Dietschreit, Muelheim/Ruhr (DE)

(73) Assignee: Siebtechnik GmbH (DE)

( * ) Notice: Subject to any disclaimer, the term of this patent is extended or adjusted under 35 U.S.C. 154(b) by 497 days.

(21) Appl. No.: 12/518,802

(22) PCT Filed: Nov. 20, 2007

(86) PCT No.: PCT/EP2007/010014

§ 371 (c)(1),
(2), (4) Date: Jun. 11, 2009

(87) PCT Pub. No.: WO2008/071290

PCT Pub. Date: Jun. 19, 2008

(65) Prior Publication Data

US 2010/0016140 A1 Jan. 21, 2010

(30) Foreign Application Priority Data

Dec. 12, 2006 (DE) ..... 10 2006 058 431

(51) Int. Cl.
*B04B 1/20* (2006.01)

(52) U.S. Cl.
USPC ..... 494/54; 198/676

(58) Field of Classification Search
USPC ..... 494/53–54; 366/64–67, 318–324; 198/657–677; 100/145–150; 416/224
See application file for complete search history.

(56) References Cited

U.S. PATENT DOCUMENTS 3,194,385 A * 7/1965 Barnese ..... 198/550.1
3,485,341 A * 12/1969 Lutz ..... 198/664
3,762,537 A * 10/1973 Lutz ..... 198/664
4,398,607 A * 8/1983 Reichardt ..... 172/119
4,519,496 A * 5/1985 Ludvigsen ..... 198/676
5,429,581 A * 7/1995 Michaud et al. ..... 494/54

FOREIGN PATENT DOCUMENTS

| | | | | |
|---|---|---|---|---|
| DE | 3140364 | A1 | * | 4/1983 |
| DE | 3527548 | A1 | * | 3/1987 |
| DE | 102006058431 | A1 | * | 6/2008 |
| DE | 102007046193 | A1 | * | 4/2009 |
| EP | 0081938 | A2 | | 6/1983 |
| GB | 2048728 | A | * | 12/1980 |
| GB | 2098517 | A | * | 11/1982 |
| GB | 2126491 | A | * | 3/1984 |
| GB | 2130508 | A | | 6/1984 |
| GB | 2150063 | A | | 6/1985 |
| JP | 58119362 | A | * | 7/1983 |
| JP | 59026813 | A | * | 2/1984 |
| JP | 62193663 | A | * | 8/1987 |
| JP | 03127643 | A | | 5/1991 |
| JP | 2012-551 | | * | 1/2012 |
| WO | 81/02853 | A1 | | 10/1981 |

OTHER PUBLICATIONS

International Search Report for PCT/EP2007/010014, Mar. 7, 2008.

* cited by examiner

*Primary Examiner* — Charles E Cooley
(74) *Attorney, Agent, or Firm* — Brooks Kushman P.C.

(57) ABSTRACT

The invention relates to an endless screw of a centrifuge for discharging centrifuged material from a centrifuge, comprising a series of thin ceramic plates which are fixed next to one another at the outer edge of the screw, characterized in that at least two formed ceramic projections, particularly ceramic pins, protrude from the thin ceramic plates and are arranged in one or two lateral faces of the edge of the screw, i.e. in recesses which are profiled according to the protrusions or pins.

11 Claims, 3 Drawing Sheets

ENDLESS SCREW OF A CENTRIFUGE WITH CERAMIC WEAR PLATES

TECHNICAL FIELD

The invention relates to an endless screw of a centrifuge for discharging centrifuged material from a centrifuge, wherein a series of thin ceramic plates are fastened next to one another on the outer edge of the endless screw.

BACKGROUND

In the case of endless screws of centrifuges, the outer edge of the endless screw walls is subjected to a particular amount of stress during the conveying and also the slowing down of the product. In order to extend the service life, it is known to fasten thin ceramic plates next to one another on the outer edge of the endless screw. It has been shown in this case that production and fastening of the thin ceramic plates are complicated and technically problematic.

SUMMARY

It is the object of the invention to improve an endless screw of a centrifuge of the type mentioned at the beginning in such a manner that, while production and fastening are simple, the thin ceramic plates are securely held even when subjected to a high amount of stress.

This object is achieved according to the invention in that at least two integrally formed ceramic projections, in particular ceramic pins, protrude from the thin ceramic plates and are located, on one or both side surfaces of the endless screw edge, in recesses which are shaped in a manner corresponding to the projections/pins.

As an alternative, it is proposed that the thin ceramic plates have at least two recesses in which are located integrally formed projections, in particular metal pins, which protrude from a side surface of the endless screw edge and are shaped in a manner corresponding to the recesses.

Such embodiments result in the thin ceramic plates being fastened with a secure form-fitting connection, with production and fastening being particularly simple. Reliable determination of the position of the thin plates is also made possible. Thin ceramic plates with recesses can be produced in a simpler manner. A greater resistance to breaking is achieved in relation to severe shearing stresses. The thin plates can also then be produced more easily from other wear-resistant materials.

The fastening is particularly simple if the projections and the corresponding recesses have a round cross section. However, as an alternative, they may also be non-round, in particular rectangular or square in cross section.

Particularly secure support and a long useful life are provided if supporting parts are fastened, in particular welded, on the outer edge of the endless screw, in particular in the form of precision castings protruding from the edge in such a manner that they expand the endless screw surface over the edge thereof and form recesses or projections, in particular pins, for the thin ceramic plates which, for this purpose, have projections, in particular pins, or recesses.

In this case, the thin ceramic plates can be adhesively bonded to the supporting parts, in particular precision castings. It is also advantageous in this case if thin ceramic plates are fastened on both sides of the supporting parts, in particular of the precision castings.

The wear is further substantially reduced and the useful life increased if, at the end facing away from the outer endless screw edge, the thin ceramic plates form a projecting surface which covers the endless screw surface on the outside in order to protect, by covering, the weld seam for fastening the supporting parts.

A lower degree of wear of the supporting parts is achieved if the sides or side edges of the supporting parts, with which they are in contact with adjacent supporting parts, are shaped obliquely and/or in a step-shaped manner in order to be in contact with one another in a form-fitting and tight manner.

Exemplary embodiments of the invention are illustrated in the drawings and are described in more detail below.

DETAILED DESCRIPTION

Figure 1:
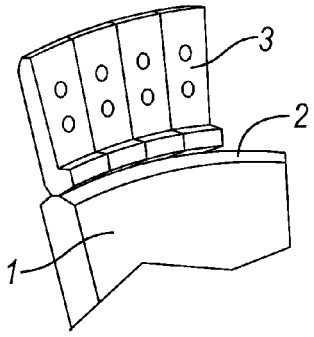
FIGS. 1 to 6 show perspectively illustrated cutouts of the outer edge of an endless screw of a centrifuge with thin ceramic plates fastened on one side.
Figure 4:
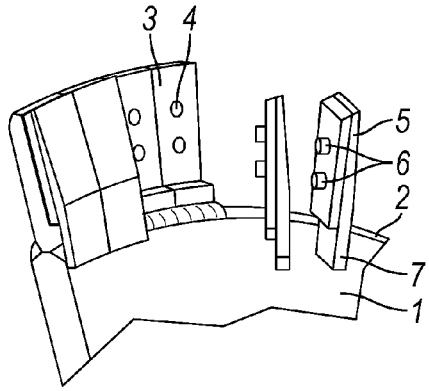
Figure 2:
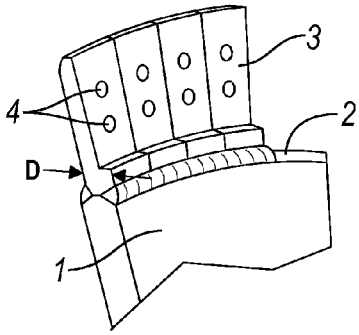
Figure 5:
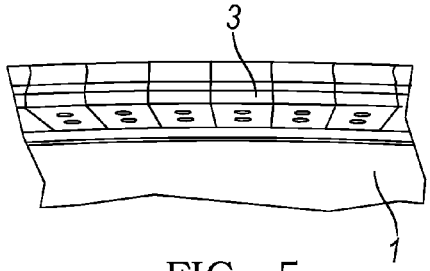
Figure 3:
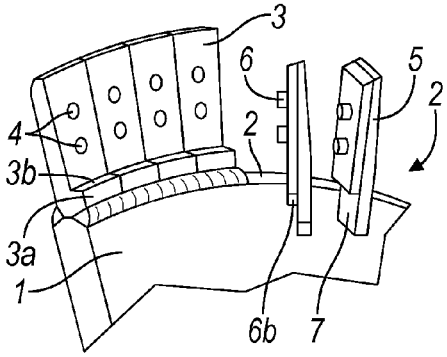
Figure 6:
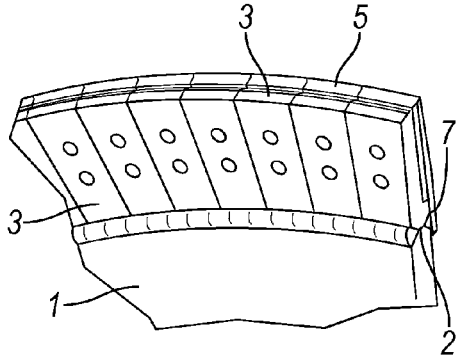

In the embodiment illustrated in FIGS. 1 to 6, the helix of an endless screw of a centrifuge 1 has an outer edge 2 on which outwardly protruding, rectangular, in particular thin-plate-like supporting parts 3, preferably made from precision casting, are fastened, in particular welded. In this case, the endless screw of a centrifuge 1 and the helix thereof are preferably composed of steel.

The supporting parts 3 which protrude radially outward each have two bores as recesses 4 which are arranged radially one above the other. Elongate, rectangular thin ceramic plates 5 are fastened to the supporting parts 3 and cover the supporting parts. Projecting, pin-shaped projections 6 are arranged and integrally formed radially one above another on the thin ceramic plates 5, the size and dimensions of which projections correspond to those of the recesses 4, and therefore the thin ceramic plates 5 can be fastened laterally to the supporting parts 3 in a form-fitting manner.

The supporting parts 3 each form a step 3*b* in the region of their foot, and therefore the foot 3*a* which is fastened to the outer edge 2 has a greater thickness D than the thickness of the adjoining outer region of the supporting part 3. Said step 3*b* is covered by a step 6*b* of the thin plate 5, with the thin ceramic plates forming, adjacent to the step 6*a*, a projecting surface 7 which projects toward the axis of the endless screw and projects toward the axis to such an extent that it projects over the endless screw surface or the helical surface and therefore also the outer edge 2 in order to protect said region optimally against wear.

On both of their sides or side edges 3*c* with which they are in contact with adjacent supporting parts 3, the supporting parts 3 which support the thin plates 5 are designed obliquely and/or in a step-shaped manner such that they overlap one another there. Gaps between the supporting parts and therefore wear are therefore prevented.

In the exemplary embodiments, the projections 6 and the recesses 4 have a round cross section and are therefore cylindrical. Instead, however, the projections and the recesses may have a non-round, in particular rectangular or square cross section.

In all of the embodiments, the width of the thin ceramic plates 5 corresponds to the width of the supporting parts 3, with a thin ceramic plate lying on each supporting part, and with the thin ceramic plates 5 not projecting outward beyond the supporting parts 3, but rather ending therewith.

Figure 7:
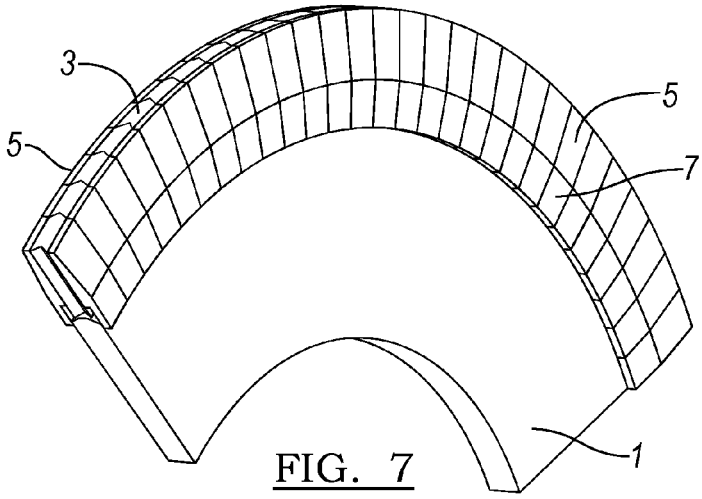
FIGS. 7 and 8 show perspective illustrations of thin ceramic plates fastened on both sides of the centrifuge edge.
Figure 8:
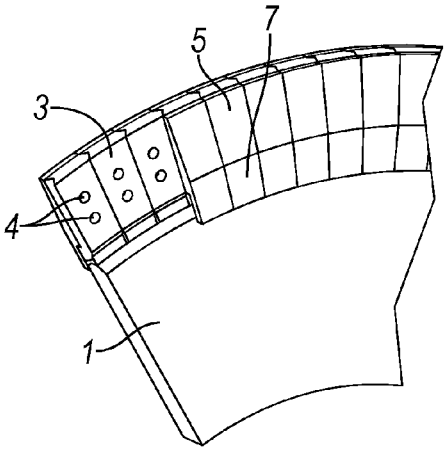
Figure 9:
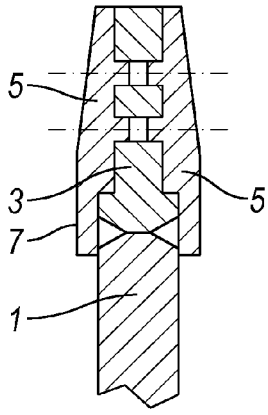
FIG. 9 shows a section through the centrifuge edge.
Figure 10:
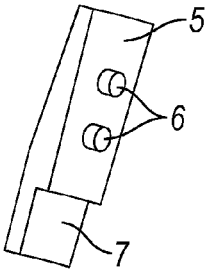
FIG. 10 shows a thin ceramic plate.
Figure 11:
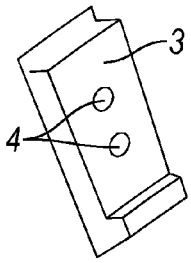
FIG. 11 shows a supporting part which can be fastened to the endless screw edge.
Figure 12:
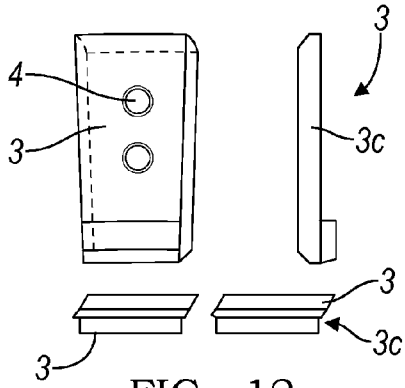
FIG. 12 shows views of the supporting parts from two sides and in top view.
Figure 13:
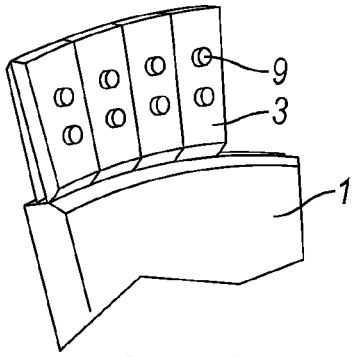
FIGS. 13 to 18 correspond to FIGS. 1 to 5 with the difference that the supporting parts have projections and the thin ceramic plates have corresponding recesses.
Figure 16:
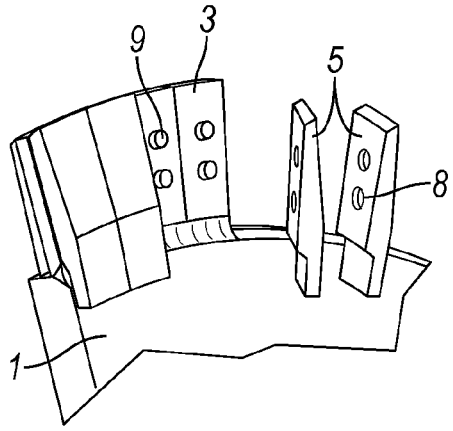
Figure 14:
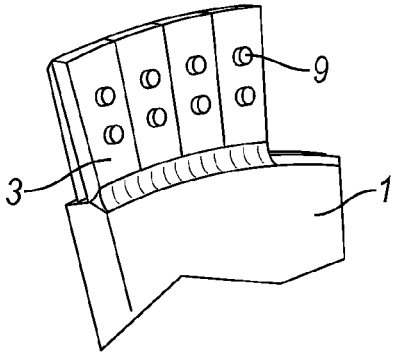
Figure 17:
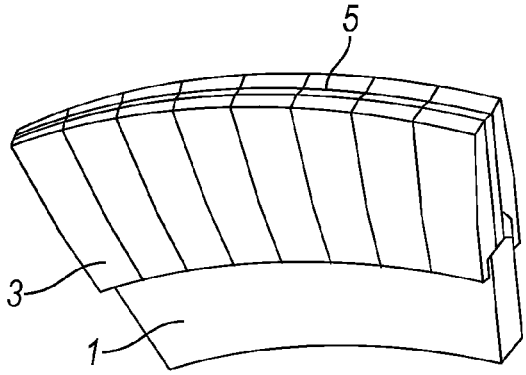
Figure 15:
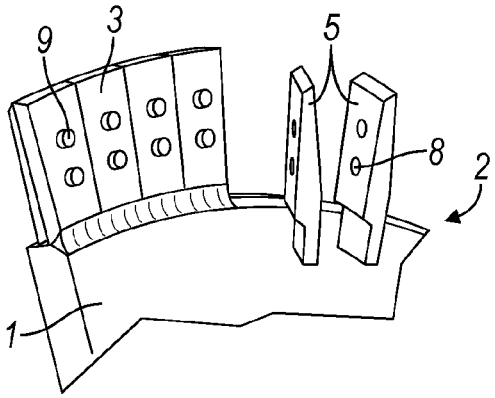
Figure 18:
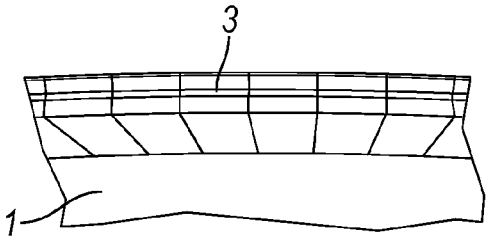

The exemplary embodiment according to FIGS. 7 to 9 differs from the previous exemplary embodiments in that thin ceramic plates 5 are fastened on both sides of the supporting parts 3, with the supporting parts 3 each having two recesses 4 on both sides, in particular continuously for use on both sides.

In all of the embodiments, the thin ceramic plates 5 are provided with additional support on the supporting parts 3 in that the thin ceramic plates are adhesively bonded to the supporting parts 3. Furthermore, instead of two projections 6 and two recesses 4, three or more projections and recesses can also be provided on the thin plates and supporting parts.

Furthermore, in all of the exemplary embodiments, the projections can be provided on the supporting parts 3 and the recesses on the thin ceramic plates 5. This is illustrated in FIGS. 13 to 18. The supporting parts 3 here have pin-shaped projections 9 which are located in a form-fitting manner in correspondingly shaped recesses 8 of the thin ceramic plates 5.

The invention claimed is:

1. An endless screw of a centrifuge for discharging centrifuged material from a centrifuge comprising:

an endless screw having a helix with an outer edge;

a plurality of precision cast supporting parts that are welded on the outer edge of the endless screw to protrude from the outer edge in such a manner to expand the endless screw surface beyond the edge thereof, wherein each precision cast supporting part has at least two recesses; and a series of thin ceramic plates next to one another fastened to the precision cast supporting parts, each ceramic plate having at least two integrally formed ceramic pins protruding therefrom, wherein the ceramic pins are shaped in a manner corresponding to the recesses of the supporting parts and are insertable therein.

2. The endless screw of a centrifuge as claimed in claim 1, wherein the pins have a round cross section.

3. The endless screw of a centrifuge as claimed in claim 1 wherein that the thin ceramic plates are adhesively bonded to the supporting parts.

4. The endless screw of a centrifuge as claimed in claim 1 wherein the thin ceramic plates are fastened on both sides of the supporting parts.

5. The endless screw of a centrifuge as claimed in claim 1, wherein the thin ceramic plates form a projecting surface which covers the endless screw outer edge.

6. The endless screw of a centrifuge as claimed in claim 1, wherein the supporting parts further comprise side edges that are in contact with adjacent supporting parts and are shaped in a manner in order to be in contact with one another in a form-fitting and tight manner.

7. An endless screw of a centrifuge for discharging centrifuged material from a centrifuge comprising:

an endless screw having a helix with an outer edge;

a plurality of precision cast supporting parts that are welded on the outer edge of the endless screw, to protrude from the outer edge in such a manner to expand the endless screw surface beyond the edge thereof; and a series of thin ceramic plates next to one another fastened to the precision cast supporting parts;

wherein each precision cast supporting part and each thin ceramic plate has at least one fastener portion, with the fastener portion of each precision cast supporting part mating to the fastener portion of a corresponding thin ceramic plate, wherein the thin ceramic plates are fastened on both sides of the supporting parts.

8. The endless screw of a centrifuge as claimed in claim 7, wherein the pin has a round cross section.

9. The endless screw of a centrifuge as claimed in claim 7, wherein the thin ceramic plates are adhesively bonded to the supporting parts.

10. The endless screw of a centrifuge as claimed in claim 7, wherein the thin ceramic plates form a projecting surface which covers the endless screw outer edge.

11. The endless screw of a centrifuge as claimed in claim 7, wherein the supporting parts further comprise side edges that are in contact with adjacent supporting parts and are shaped in a manner in order to be in contact with one another in a form-fitting and tight manner.

* * * * *